US005590739A

United States Patent [19]

High et al.

[11] Patent Number: 5,590,739

[45] Date of Patent: Jan. 7, 1997

[54] ADJUSTABLE EXTENSION STEPLADDER

[76] Inventors: DeWayne A. High, c/o 14407 SE. Yamhill, Portland, Oreg. 97233; Timm J. Timmermann, 1736 E. Charlston Blvd., Suite 219, Las Vegas, Nev. 89104

[21] Appl. No.: 301,636

[22] Filed: Nov. 1, 1994

[51] Int. Cl.[6] ..... E06C 1/30

[52] U.S. Cl. ..... 182/169; 182/22; 182/172; 182/208; 182/211

[58] Field of Search ..... 182/169, 174, 182/172, 165, 208, 211, 170, 22, 26, 180

[56] References Cited

U.S. PATENT DOCUMENTS

| | | | |
|---|---|---|---|
| 215,712 | 5/1879 | Andrews | 182/214 X |
| 534,463 | 2/1895 | Bowser | 182/174 X |
| 570,939 | 11/1896 | Mack | 182/208 X |
| 976,240 | 11/1910 | Winkler | 182/169 X |
| 1,670,653 | 5/1928 | Cummins | 182/169 X |
| 2,261,479 | 11/1941 | Moen | 182/172 X |
| 3,196,981 | 7/1965 | Winnall | 182/208 X |
| 3,464,522 | 9/1969 | Kramer | 182/211 |
| 3,933,221 | 1/1976 | Sorenson | 182/172 |
| 5,033,584 | 7/1991 | Battle | 182/208 X |

*Primary Examiner*—Alvin C. Chin-Shue

*Attorney, Agent, or Firm*—DeWayne A. High; Timm J. Timmermann

[57] ABSTRACT

A motorized utility extension ladder having a main and upper riser section extendable by a motor. The ladder further comprising a telescopic prop so that the ladder may be free standing, side wing legs for stabilizing the ladder, wheels for transporting the ladder, and a removable shelf.

1 Claim, 2 Drawing Sheets

ADJUSTABLE EXTENSION STEPLADDER

This invention is an all-in-one motorized utility ladder designed for use as a free standing extension ladder, stepladder or for any use requiring complete adjustability such as stairs, uneven surfaces etc.

This motorized utility ladder is an improvement on all existing stepladders and is comprised of a lower main section with side wing support legs and support pads, an upper section with removable utility shelf and tool holder, a telescopic tripod leg and a horizontal support arm.

The invention is described in the accompanying illustrations wherein.

Figures 1, 4, 5, 6, 7, 8, 9, 10, 11:
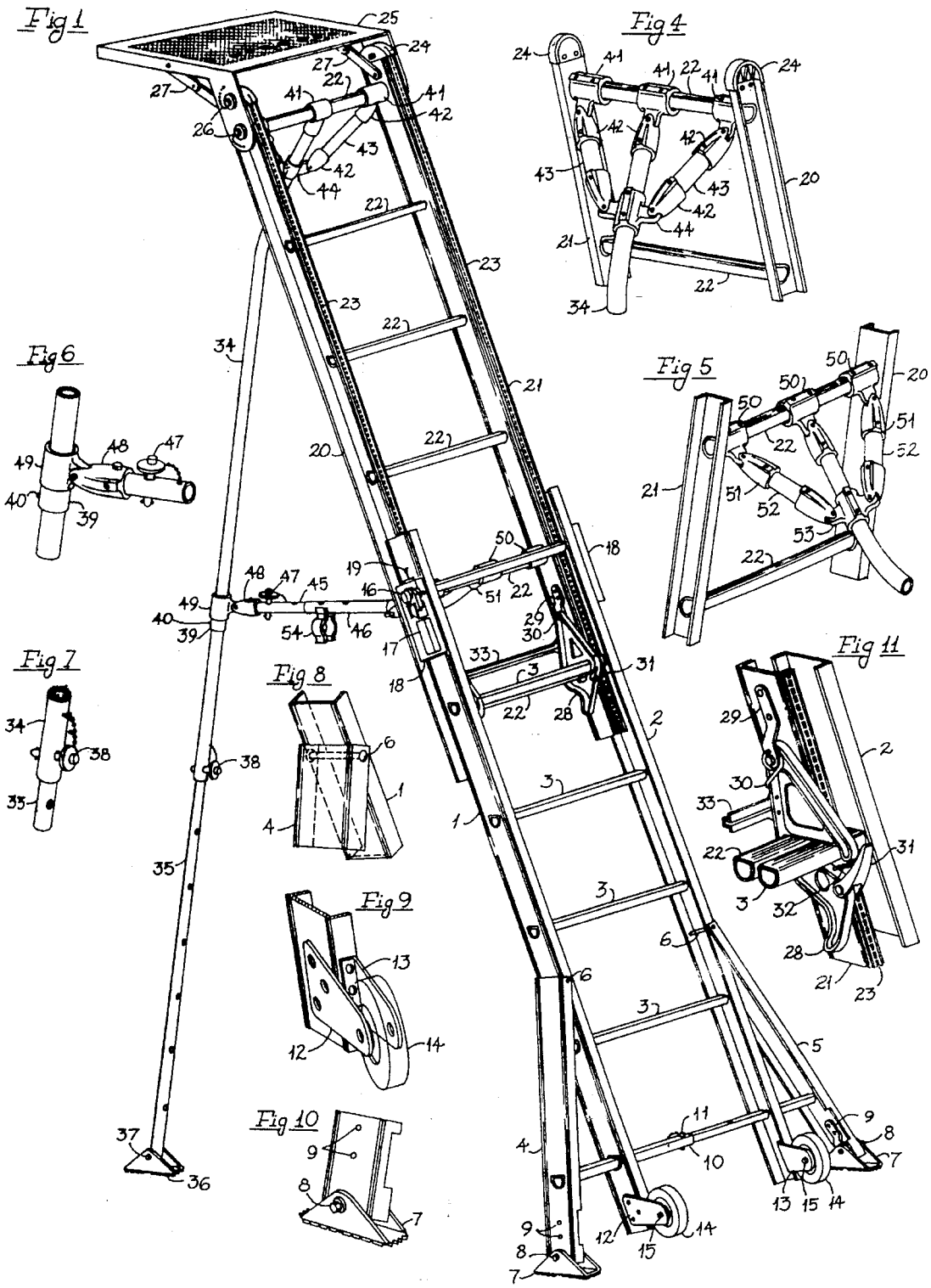
FIG. 1 is a perspective view of this ladder in the fully extended configuration with utility shelf locked in working position, tripod support leg and A-Frame side legs in extended position.
FIG. 4 is a cutaway perspective view of the top support structure for the center tripod support leg.
FIG. 5 is a cutaway perspective view of the center support for the horizontal extension arm.
FIG. 6 is a cutaway perspective showing the attachment Structure of the telescopic horizontal arm to vertical support leg with the locking quick release pin in place.
FIG. 7 is a cutaway perspective showing the telescopic support leg with locking quick release pin in place.
FIG. 8 is a cutaway perspective showing the attachment of the side wing support legs to the main vertical risers of the ladder.
FIG. 9 shows a cutaway perspective view of the support brackets for the transport wheels.
FIG. 10 is a perspective view of the main support feet attached to the side wing support legs.
FIG. 11 is a perspective view of the right locking bracket for the upper section of the ladder.
Figures 2, 3, 12, 13, 14:
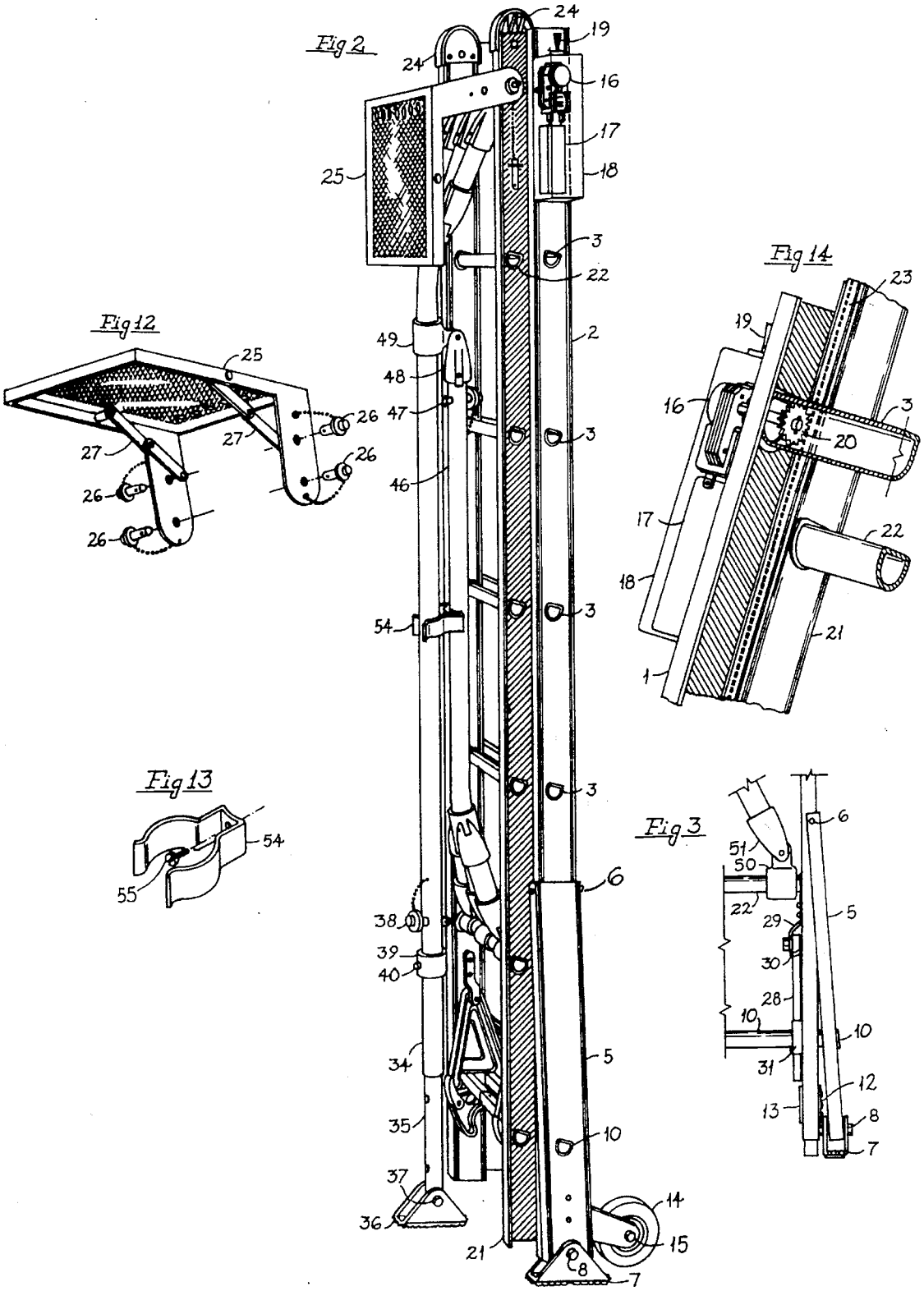
FIG. 2 is a perspective view of this ladder in the fully folded configuration for storage or transporting with the use of dolly type wheels.
FIG. 3 is a cross section view showing the side wing legs in the closed position.
FIG. 12 is a perspective view of the removable utility shelf and tool holder with its quick release locking pins.
FIG. 13 is a perspective of the vertical leg to horizontal support arm locking clip used when storing the ladder.
FIG. 14 is a cutaway perspective view of the motor, battery and related gears for raising upper section of ladder.

The lower main section of side pieces 1 & 2; hereafter noted as risers, steps 3; hereafter noteds as rungs, folding side wings 4 & 5, hinged by rod 6 with their supporting foot pads 7, attachment bolts and nuts 8 and riveted brackets 9, and telescopic rung 10 with its locking pin 11. Attached to main risers 1 & 2 are riveted 12 & 13, which holds the support wheels 14 and axles 15. Attached at the top of the main section risers 1 & 2 are the motors 16, rechargable batteries 17, motor and battery housing 18 with up and down switch 19 used to raise and lower upper section of ladder.

The upper section which slides up & down inside the main risers 1 & 2 consists of risers 20 & 21, rungs 22, strip gears 23, which engage sprocket gear 20 to raise and lower upper section, riveted top caps 24, utility shelf and tool holder 25 with its quick release pins and safety chains 26, folding support brackets 27, ladder locking devices 28 with riveted attachment bracket 29, tension spring 30, safety clip 31, return spring 32 and connecting bracket 33 which connects both locking devices 28.

The telescopic tripod leg 34 & 35 consists of: foot pads 36 and attaching bolts and nuts 37, quick release adjusting pin with with safety chain 38, stop collar 39 with set screw 40, attachment to the top rung 22 of upper section collars 41, brackets with set screws 42, connecting rods 43 and sliding collar with set screw 44.

The adjustable horizontal support arm consists of: telescopic arms 45 & 46, quick release locking pin with safety chain 47, horizontal arm to tripod leg bracket with set screws 48, sliding collar 49, attachment collar 50 to second rung 22 of upper section, brackets with set screw 51 connecting rods 52, sliding collar with set screws 53, retaining clip 54 and self tapping screw 55.

Having thus described the invention, what is claimed is:

1. A motorized utility ladder comprising a main riser section and an upper riser section, means for raising and lowering the upper section relative to the main section comprising a motor, battery housing with up and down switch, and a sprocket attached to the main section and a strip gear attached to the upper section, said ladder further comprising a telescopic tripod leg having a foot pad, a quick release adjusting pin with a safety chain, a stop collar, the top of the tripod leg having a bracket comprising a sliding collar slidably attached to the tripod leg, connecting rods and collars for attachment to a top rung of the upper section, an adjustable horizontal telescopic arm having a collar at one end attached to the tripod leg, and a bracket with a sliding collar, connecting rods and collars attached to a lower rung of the upper section, a utility shelf pivotally attached to the top of the upper section by quick release pins to enable removal of the shelf from the ladder, a pair of side wing legs hinged to the bottom of the main section, said wing legs comprising a telescopic members forming a bottom telescopic rung for the main section, said ladder having a pair of transport wheels attached to the lower end of the main section by support brackets, a pair of spring assisted pivot locks with spring assisted front clips attached to a lower portion of the upper section for locking the upper and main section at selected extensions.

* * * * *